US009400108B2

(12) United States Patent
Portillo Bilbao et al.

(10) Patent No.: US 9,400,108 B2
(45) Date of Patent: Jul. 26, 2016

(54) ACOUSTIC DAMPING SYSTEM FOR A COMBUSTOR OF A GAS TURBINE ENGINE

(71) Applicants: Juan Enrique Portillo Bilbao, Oviedo, FL (US); Rajesh Rajaram, Oviedo, FL (US); Danning You, Shanghai (CN); Kevin M. Spence, Winter Springs, FL (US)

(72) Inventors: Juan Enrique Portillo Bilbao, Oviedo, FL (US); Rajesh Rajaram, Oviedo, FL (US); Danning You, Shanghai (CN); Kevin M. Spence, Winter Springs, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 538 days.

(21) Appl. No.: 13/893,441

(22) Filed: May 14, 2013

(65) Prior Publication Data

US 2014/0338332 A1 Nov. 20, 2014

(51) Int. Cl.

| | |
|---|---|
| ***F23R 3/60*** | (2006.01) |
| ***F23R 3/00*** | (2006.01) |
| ***F23M 20/00*** | (2014.01) |

(52) U.S. Cl.

CPC ..... *F23M 99/005* (2013.01); *F23M 20/005* (2015.01); *F23R 3/002* (2013.01); *F23R 3/60* (2013.01); *F23R 2900/00014* (2013.01)

(58) Field of Classification Search

CPC .. F23R 3/002; F23R 3/60; F23R 2900/00014; F23M 20/005; F02C 7/24; F05D 2260/96; F05D 2260/963; F01D 25/04

USPC ..... 60/725

See application file for complete search history.

(56) References Cited

U.S. PATENT DOCUMENTS

| | | | | |
|---|---|---|---|---|
| 4,409,787 | A * | 10/1983 | Davi | F23M 20/005 60/39.77 |
| 5,353,598 | A * | 10/1994 | Huck | F02K 1/827 181/213 |
| 5,644,918 | A * | 7/1997 | Gulati | F23R 3/002 431/114 |
| 5,685,157 | A | 11/1997 | Pandalai et al. | |
| 6,305,927 | B1 | 10/2001 | Keller | |
| 6,530,221 | B1 | 3/2003 | Sattinger et al. | |
| 6,546,729 | B2 | 4/2003 | Hellat et al. | |
| 6,634,457 | B2 | 10/2003 | Paschereit et al. | |
| 6,981,358 | B2 * | 1/2006 | Bellucci | F23D 11/402 60/39.17 |
| 7,089,741 | B2 * | 8/2006 | Ikeda | F23R 3/002 60/725 |
| 7,322,195 | B2 | 1/2008 | Borja et al. | |
| 7,334,408 | B2 | 2/2008 | Bethke et al. | |

(Continued)

FOREIGN PATENT DOCUMENTS

| | | |
|---|---|---|
| CN | 102192505 | 9/2011 |
| EP | 1174662 A1 | 1/2002 |

(Continued)

*Primary Examiner* — Gerald L Sung
*Assistant Examiner* — Alain Chau

(57) ABSTRACT

An acoustically dampened gas turbine engine having a gas turbine engine combustor with an acoustic damping resonator system is disclosed. The acoustic damping resonator system may be formed from one or more resonators positioned within the gas turbine engine combustor at an outer housing forming a combustor basket and extending circumferentially within the combustor. The resonator may be positioned in a head region of the combustor basket. In one embodiment, the resonator may be positioned in close proximity to an intersection between the outer housing and an upstream wall defining at least a portion of the combustor. The acoustic damping resonator system may mitigate longitudinal mode dynamics thereby increasing an engine operating envelope and decreasing emissions.

8 Claims, 3 Drawing Sheets

(56) References Cited

U.S. PATENT DOCUMENTS

| | | | | |
|---|---|---|---|---|
| 7,413,053 | B2 * | 8/2008 | Wasif | F23M 20/005 181/210 |
| 7,448,215 | B2 * | 11/2008 | Macquisten | F23M 20/005 181/220 |
| 7,464,552 | B2 | 12/2008 | Sattinger | |
| 7,549,506 | B2 | 6/2009 | Sattinger | |
| 7,788,926 | B2 * | 9/2010 | Johnson | F23R 3/286 181/210 |
| 7,832,211 | B2 | 11/2010 | Ikeda et al. | |
| 7,857,094 | B2 | 12/2010 | Macquisten et al. | |
| 7,886,543 | B2 | 2/2011 | Vincent | |
| 7,891,195 | B2 | 2/2011 | Bouy et al. | |
| 7,926,278 | B2 | 4/2011 | Gerendás et al. | |
| 8,127,546 | B2 | 3/2012 | Park | |
| 2002/0066272 | A1 | 6/2002 | Suenaga et al. | |
| 2004/0211185 | A1 | 10/2004 | Young et al. | |
| 2005/0103018 | A1 | 5/2005 | Graf et al. | |
| 2005/0106519 | A1 | 5/2005 | Flohr et al. | |
| 2008/0053097 | A1 * | 3/2008 | Han | F23R 3/286 60/737 |
| 2008/0295519 | A1 * | 12/2008 | Park | F23R 3/28 60/740 |
| 2010/0011769 | A1 | 1/2010 | Gambacorta et al. | |
| 2010/0089068 | A1 | 4/2010 | Ellis et al. | |
| 2010/0251718 | A1 | 10/2010 | Ito et al. | |
| 2010/0284789 | A1 * | 11/2010 | Brooks | F01D 5/26 415/119 |
| 2010/0293952 | A1 | 11/2010 | Jain et al. | |
| 2011/0005233 | A1 * | 1/2011 | Sadig | F23R 3/04 60/754 |
| 2011/0048021 | A1 | 3/2011 | Slobodyanskiy et al. | |
| 2012/0102963 | A1 | 5/2012 | Corr et al. | |
| 2013/0081397 | A1 * | 4/2013 | Overby | F23R 3/10 60/746 |

FOREIGN PATENT DOCUMENTS

| | | | | |
|---|---|---|---|---|
| EP | 2522910 | A1 * | 11/2012 | F23R 3/002 |
| GB | 2452476 | | 3/2009 | |
| JP | 2161134 | | 6/1990 | |
| JP | 6221563 | | 8/1994 | |

* cited by examiner

ACOUSTIC DAMPING SYSTEM FOR A COMBUSTOR OF A GAS TURBINE ENGINE

FIELD OF THE INVENTION

The present invention relates in general to gas turbine engines and, more particularly, to acoustic damping systems for damping longitudinal mode dynamics in combustor baskets in gas turbine engines.

BACKGROUND OF THE INVENTION

Gas turbine engines typically include a plurality of combustor baskets positioned downstream from a compressor and upstream from a turbine assembly. During operation, longitudinal mode dynamics often occurs in the combustor baskets, as shown in FIGS. 1-3. The longitudinal mode dynamics usually originates at the inlet of the air flow path in a combustor basket and travels downstream to the turbine inlet. The dynamics restrict the tuning flexibility of the gas turbine engine in order to operate at lower emissions, which is an ever increasing requirement for newer gas turbines.

SUMMARY OF THE INVENTION

Set forth below is a brief summary of the invention that solves the foregoing problems and provides benefits and advantages in accordance with the purposes of the present invention as embodied and broadly described herein. This invention is directed to acoustically dampened gas turbine engine having a gas turbine engine combustor with an acoustic damping resonator system. The acoustic damping resonator system may be formed from one or more resonators positioned within the gas turbine engine combustor at an outer housing and extending circumferentially within the combustor. The resonator may be positioned in a head region of the combustor basket. In one embodiment, the resonator may be positioned in close proximity to an intersection between the outer housing and an upstream wall defining at least a portion of the combustor. The acoustic damping resonator system may mitigate longitudinal mode dynamics thereby increasing an engine operating envelope and decreasing emissions.

The turbine engine having an acoustic damping resonator system may include a gas turbine engine combustor positioned downstream from a compressor and formed from one or more outer housings defining a combustor basket and at least one upstream wall that is attached to the outer housing. One or more fuel nozzles of a fuel nozzle assembly may extend into the combustor. The resonator may be positioned within the gas turbine engine combustor at the outer housing and may extend circumferentially within the combustor. The resonator may also be positioned radially outward from at least one outer wall of the fuel nozzle assembly and the resonator may contact the upstream wall.

In one embodiment, the resonator may contact the upstream wall and the outer housing defining the combustor basket. In another embodiment, the resonator may be attached to the outer housing of the combustor basket and to the upstream wall. The resonator may also be positioned at the upstream wall and may extend circumferentially within the combustor. The resonator may also be positioned at an intersection of the upstream wall and an outer housing defining the combustor basket. In another embodiment, the resonator may be positioned radially outward from at least one outer wall of the fuel nozzle assembly.

One or more resonator necks may extend between the resonator and the gas turbine engine combustor. The resonator neck may contact the resonator and an intersection of the upstream wall and the outer housing defining the combustor basket.

The resonator may have a number of different configurations. The resonator may extend only partially circumferentially around the combustor. Also there may be two or more resonators positioned radially around the fuel nozzle assembly. In at least one embodiment, the resonator may be curved. More particularly, the resonator may be curved about an axis that extends through a longitudinal axis of the gas turbine engine combustor and may be positioned orthogonal to the longitudinal axis of the gas turbine engine combustor. In another embodiment, the resonator may extend linearly between the outer housing defining the combustor basket and the upstream wall.

During use, the acoustic damping system may dampen the longitudinal mode combustor dynamics, thereby permitting the gas turbine engine operating envelope to be increased. The acoustic damping system may function as a flow conditioner by creating a more uniform flow at the head end and by creating better mixing downstream.

These and other advantages and objects will become apparent upon review of the detailed description of the invention set forth below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
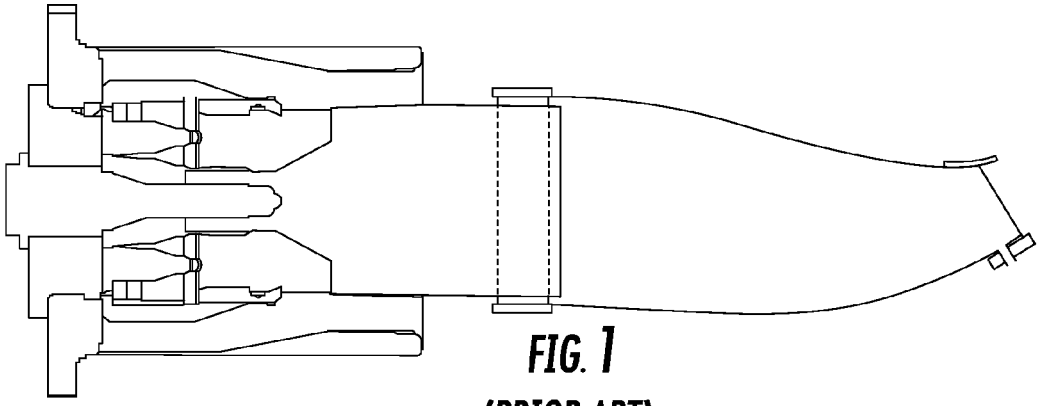
FIG. 1 (PRIOR ART)
FIG. 1 is cross-sectional side view of a conventional combustor basket of a gas turbine engine.
Figure 2:
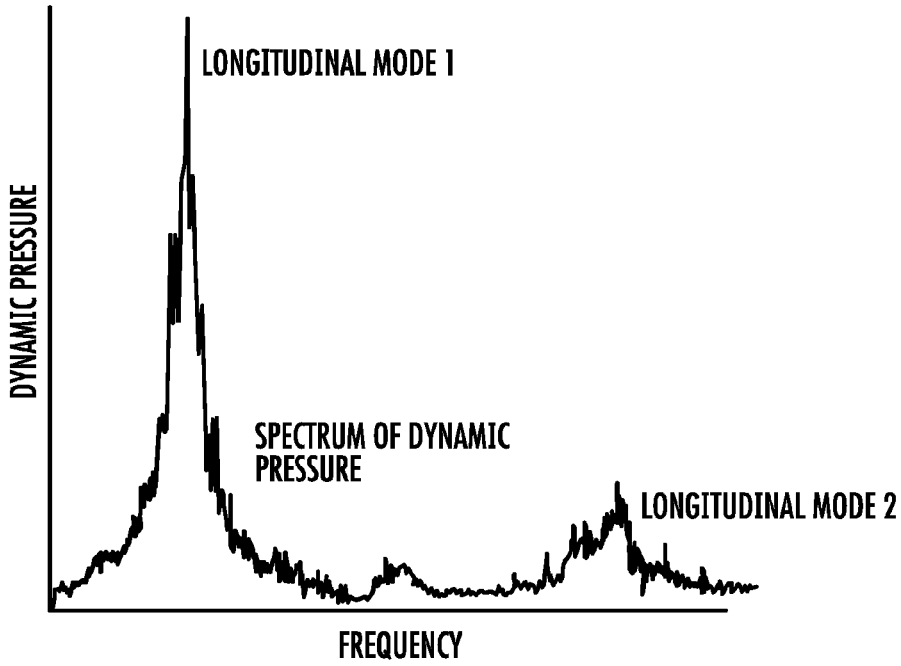
FIG. 2 (PRIOR ART)
FIG. 2 is a prior art graph of longitudinal mode dynamics of dynamic pressure versus frequency.
Figure 3:
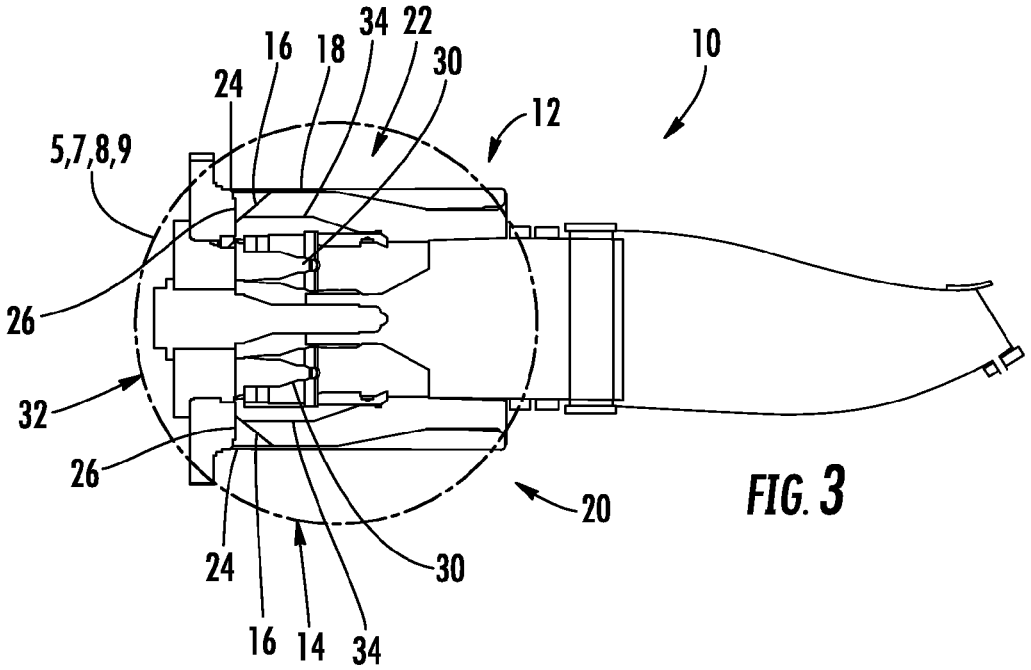
FIG. 3 is a cross-sectional side view of a combustor basket of a gas turbine engine.
Figure 4:
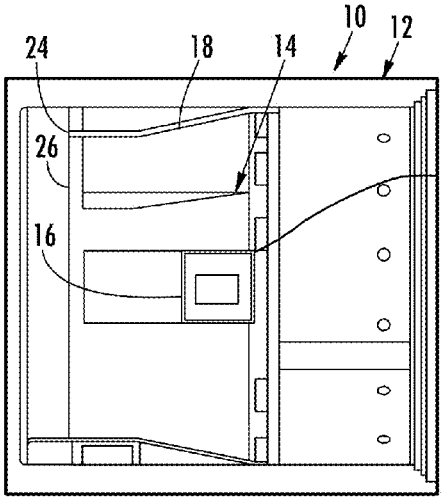
FIG. 4 is a partial cross-sectional side view of an acoustic damping system positioned within the combustor basket taken at detail 5 in FIG. 3.
Figure 5:
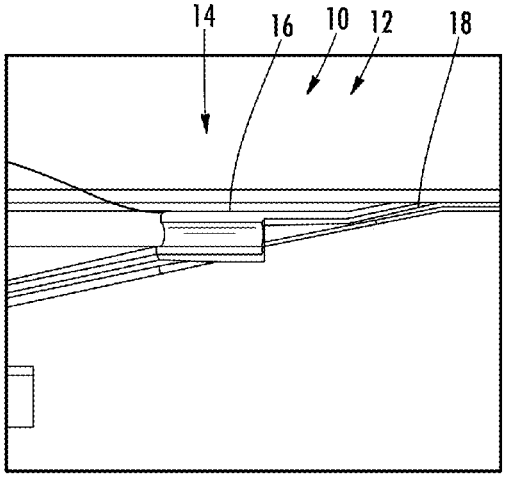
FIG. 5 is a side view of a resonator positioned in an outer housing forming a combustor basket shown in FIG. 4.

As shown in FIGS. 3-8, this invention is directed to an acoustically dampened gas turbine engine 10 having a gas turbine engine combustor 12 with an acoustic damping resonator system 14. The acoustic damping resonator system 14 may be formed from one or more resonators 16 positioned within the gas turbine engine combustor 12 at an outer housing 18 and extending circumferentially within the combustor 12. The resonator 16 may be positioned in a head region 20 of the combustor basket 22. In one embodiment, the resonator 16 may be positioned in close proximity to an intersection 24 between the outer housing 18 and an upstream wall 26 defining at least a portion of the combustor 12. The acoustic damping resonator system 14 may mitigate longitudinal mode dynamics thereby increasing an engine operating envelope and decreasing emissions.

The acoustic damping resonator system 14 may be positioned within a gas turbine engine 10. The gas turbine engine 10 may be any turbine engine having combustors. In at least one embodiment, the acoustic damping resonator system 14 may be positioned within a gas turbine engine 10 having one or more can-annular combustors 12. In at least one embodiment, the gas turbine engine combustor 12 may be positioned downstream from a compressor. The compressor may have any appropriate configuration. The gas turbine engine combustor 12 may be formed from one or more outer housings 18 defining a combustor basket 22 and one or more upstream walls 26 that may be attached to the outer housing 18. One or more fuel nozzles 30 may extend into the combustor 12. The fuel nozzle 30 may have any appropriate configuration.

The resonator 16 may be positioned within the gas turbine engine combustor 12 at the outer housing 18 and may extend circumferentially within the combustor 12. The resonator 16 may be positioned radially outward from a fuel nozzle assembly 32. The fuel nozzle assembly 32 may be include an outer wall 34 that surrounds at least a portion of the fuel nozzle 30. The outer wall 34 may have a generally cylindrical shape with an open distal end 36. The resonator 16 maybe positioned radially outward from the outer wall 34. The resonator 16 may also extend laterally in relation to the outer wall, as shown in FIG. 8.

The resonator 16 may be positioned radially outward from the outer wall 34 of the housing and may contact the upstream wall 26. In another embodiment, the resonator 16 may contact both the upstream wall 26 and the outer housing 18 of the combustor basket 22. In yet another embodiment, the resonator 16 may be attached to the upstream wall 26 or the outer housing 18, or both. The resonator 16 may be attached to the outer housing 18 of the combustor basket 22 and to the upstream wall 26.

Figure 6:
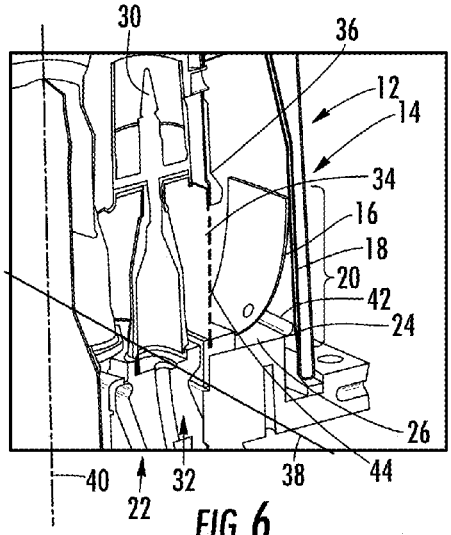
FIG. 6 is partial cross-sectional view of a resonator positioned at a radially outer wall of a combustor basket near an inlet to the combustor.
Figure 7:
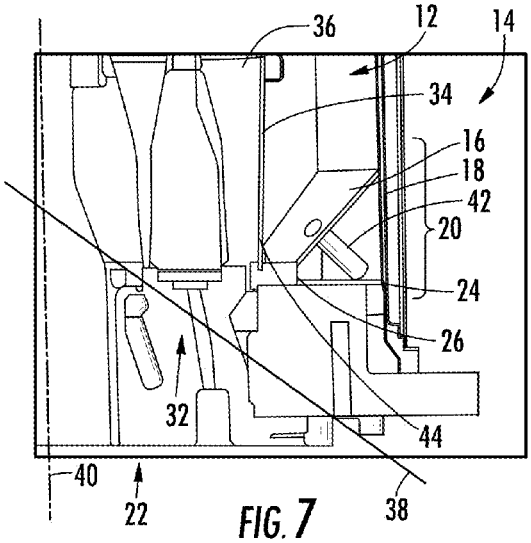
FIG. 7 is partial cross-sectional view of another resonator positioned at a radially outer wall of a combustor basket near an inlet to the combustor.
Figure 8:
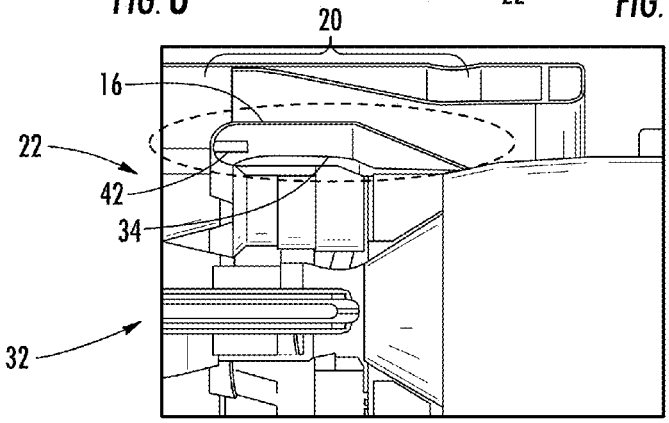
FIG. 8 is a partial cross-sectional side view of yet another embodiment of the acoustic damping system having a resonator positioned on an inner side of a turn at the inlet of the combustor.

In one embodiment, as shown in FIG. 6-8, the resonator 16 may be positioned at the upstream wall 26 and may extend circumferentially within the combustor 12. The resonator 16 may contact the upstream wall 26 and the outer housing 18 defining the combustor basket 22. The resonator 16 may be positioned at an intersection 24 of the upstream wall 26 and an outer housing 18 defining the combustor basket 22. The resonator 16 may be positioned radially outward from an outer wall 34 forming at least one outer wall 34 of the fuel nozzle assembly 32.

As shown in FIG. 6, the resonator 16 may be curved in addition to being curved about a longitudinal axis 40 of the gas turbine engine combustor 12. More specifically, the resonator 16 may be curved about an axis 38 that is positioned orthogonal to the longitudinal axis 40 of the gas turbine engine combustor 12. In at least one embodiment, the axis 38 may also extend through the longitudinal axis 40 of the gas turbine engine combustor 12. As previously mentioned, the resonator 16 may also be curved about the longitudinal axis 40 of the gas turbine engine combustor 12 or may be linear about the longitudinal axis 40. One or more resonators 16 may be positioned circumferentially around the combustor 12.

In yet another embodiment, as shown in FIG. 7, the resonator 16 may extend linearly between the outer housing 18 defining the combustor basket 22 and the upstream wall 26. In this embodiment, the resonator 16 may also be curved about the longitudinal axis 40 of the gas turbine engine combustor 12 or may be linear about the longitudinal axis 40. One or more resonators 16 may be positioned circumferentially around the combustor 12.

The acoustics damping system 14 may include a resonator neck 42 extending between the resonator 16 and the gas turbine engine combustor 12, as shown in FIGS. 6-8, The resonator neck 42 may contact the resonator 16 and the intersection 24 of the upstream. wall 26 and the outer housing 18 defining the combustor basket 22. The resonator neck 42 may have any appropriate configuration. In at least one embodiment, the resonator neck 42 may be generally cylindrical. The resonator neck 42 may be a single, unitary member Or may be formed from two or more components. The resonator neck 42 may be arranged as a support member to couple the resonator 16 to the combustor 12, such as to the outer housing 18 or the upstream wall 26, or both, as shown in FIGS. 6 and 7. Alternatively, the resonator neck 42 may be coupled to the resonator 1.6 and contact the combustor 12. As shown in FIGS. 6 and 7, the resonator neck 42 may extend through the resonator 16 and form a hole in the resonator 16. The resonator neck 42 shown in FIG. 8 may extend axially.

During use, the acoustic damping system 14 may dampen the longitudinal mode combustion dynamics, thereby permitting the turbine engine operating envelope to be increased. The acoustic damping system 14 may function as a flow conditioner by creating a more uniform flow at the combustor inlet 44 and by creating better mixing profile downstream.

The foregoing is provided for purposes of illustrating, explaining, and describing embodiments of this invention. Modifications and adaptations to these embodiments will be apparent to those skilled in the art and may be made without departing from the scope or spirit of this invention or the following claims.

We claim:

1. A turbine engine with an acoustic clamping resonator system, comprising:

a gas turbine engine combustor positioned downstream from a compressor and formed from at least one outer housing defining a combustor basket and at least one upstream wall that is attached to the at least one outer housing, wherein at least one fuel nozzle of a fuel nozzle assembly extends into the combustor;

at least one resonator positioned within the gas turbine engine combustor at the at least one outer housing and extending circumferentially within the combustor;

wherein the at least one resonator is positioned radially outward from at least one outer wall of the fuel nozzle assembly;

wherein the at least one resonator contacts the at least one upstream wall;

wherein the at least one resonator is curved about an axis that is positioned orthogonal to the longitudinal axis of the gas turbine engine combustor forming a curved surface such that the curved surface faces radially inward toward the longitudinal axis;

a resonator neck extending between the at least one resonator and the gas turbine engine combustor, wherein the resonator neck is arranged as a support member to coupe the resonator and an intersection of the at least one upstream wall and the outer housing defining the combustor basket; and wherein the resonator neck is a hollow member and forms a hole on the curved surface of the resonator.

2. The turbine engine with an acoustic damping resonator system of claim 1, wherein the at least one resonator is attached to the at least one outer housing of the combustor basket and to the at least one upstream wall.

3. The turbine engine with an acoustic damping resonator system of claim 1, wherein the at least one resonator is positioned at the at least one upstream wall and extends circumferentially within the combustor.

4. The turbine engine with an acoustic damping resonator system of claim 1, wherein the at least one resonator contacts the at least one upstream wall and the at least one outer housing defining the combustor basket.

5. The turbine engine with an acoustic damping resonator system of claim 1, wherein the at least one resonator is positioned at an intersection of the at least one upstream wall and an outer housing defining the combustor basket.

6. A turbine engine with an acoustic damping resonator system, comprising:

a gas turbine engine combustor positioned downstream from a compressor and formed from at least one outer housing defining a combustor basket and at least one upstream wall that is attached to the at least one outer housing, wherein at least one fuel nozzle of a fuel nozzle assembly extends into the combustor;

at least one resonator positioned within the gas turbine engine combustor at the at least one outer housing and extending circumferentially within the combustor; wherein the at least one resonator is positioned radially outward from at least one outer wall of the fuel nozzle assembly, wherein the at least one resonator contacts the at least one outer housing and the at least one upstream wall, and the at least one resonator is curved about an axis that is positioned orthogonal to the longitudinal axis of the gas turbine engine combustor forming a curved surface such that the curved surface faces radial inward toward the longitudinal axis;

a resonator neck extending between the at least one resonator and the gas turbine engine combustor, wherein the resonator neck is arranged as a support member to couple the resonator and an intersection of the at least one upstream wall and the outer housing defining the combustor basket; and wherein the resonator neck is a hollow member and forms a hole on the curved surface of the resonator.

7. The turbine engine with an acoustic damping resonator system of claim 6, wherein the at least one resonator is positioned at the at least one upstream wall and extends circumferentially within the combustor.

8. The turbine engine with an acoustic damping resonator system of claim 6, wherein the at least one resonator is positioned at an intersection of the at least one upstream wall and the at least one outer housing defining the combustor basket, and wherein the at least one resonator is attached to the at least one outer housing and to the at least one upstream wall.

* * * * *